US005737932A

United States Patent [19]

Lee

[11] Patent Number: 5,737,932

[45] Date of Patent: Apr. 14, 1998

[54] REFRIGERATOR HAVING CONTROLLER FOR SUPPLYING WATER FROM A RESERVOIR TO EITHER AN ICE MAKER OR AN OUTSIDE DISPENSER

[75] Inventor: Kun Bin Lee, Seoul, Rep. of Korea

[73] Assignee: Samsung Electronics Co., Ltd., Suwon, Rep. of Korea

[21] Appl. No.: 735,599

[22] Filed: Oct. 23, 1996

[30] Foreign Application Priority Data

Oct. 31, 1995 [KR] Rep. of Korea ..... 95-38839
Oct. 16, 1996 [KR] Rep. of Korea ..... 96-46384

[51] Int. Cl.[6] ..... F25C 1/00

[52] U.S. Cl. ..... 62/135; 62/340; 62/389; 222/63; 222/146.6; 222/485

[58] Field of Search ..... 62/135, 340, 389; 222/63, 146.6, 483, 484, 485

[56] References Cited

U.S. PATENT DOCUMENTS 3,969,909 7/1976 Barto et al. ..... 62/340
5,404,052 4/1995 Sawyer, III ..... 222/146.6
5,511,388 4/1996 Taylor et al. ..... 62/389
5,558,256 9/1996 Miller et al. ..... 222/63

*Primary Examiner*—William E. Tapolcai
*Attorney, Agent, or Firm*—Burns, Doane, Swecker & Mathis, L.L.P.

[57] ABSTRACT

A refrigerator includes an automatic ice maker and a dispenser for dispensing water to the outside of the refrigerator. The ice maker and dispenser are supplied with water from a common reservoir by a common pump. A valve is actuated by a controller to communicate the reservoir with either the dispenser or the ice maker, but not with both simultaneously. The controller acts in response to water-needed signals from the dispenser and ice maker, but always gives precedent to the dispenser signal. If water is in the process of being supplied to the ice maker when a water-needed signal is received from the dispenser, the water supply will be temporarily diverted to the dispenser until the dispenser no longer needs water.

3 Claims, 5 Drawing Sheets

REFRIGERATOR HAVING CONTROLLER FOR SUPPLYING WATER FROM A RESERVOIR TO EITHER AN ICE MAKER OR AN OUTSIDE DISPENSER

BACKGROUND OF THE INVENTION

The present invention relates to a refrigerator having an automatic ice maker and a door-mounted water dispenser to both of which water is supplied from a single water reservoir tank.

A refrigerator provided with an automatic ice maker for automatically making ice is widely used. In such a refrigerator, a manually actuable water dispenser is usually provided in the front surface of a refrigerator door. The water is automatically supplied to the automatic ice maker or to the water dispenser from a water reservoir tank provided in the refrigerator, under the control of a microcomputer.

FIG. 1 is a block diagram for explaining a control process of a water supply procedure in a conventional ice maker. If water contained in an ice tray is completely frozen, an ice removal sensor 40 disposed beneath the ice tray senses the temperature of the tray, and supplies the sensed result to an ice removal determiner 50. The ice removal determiner 50 determines that an ice making operation is completed when the sensed temperature is not more than a predetermined temperature, and then supplies corresponding information to a microcomputer 10. The microcomputer 10 outputs a signal for execution of an ice removal operation to an ice removal motor controller 20 based on the signal output from the ice removal determiner 50. Then, the ice removal motor controller 20 drives an ice removal motor 30. The tray is inverted according to the drive of the ice removal motor 30 so that the ice is removed from the ice tray and received by an ice dispenser vessel. Upon completion of the ice removal operation, the tray is reversed to the upright position according to a restoring operation of the ice removal motor 30.

When the tray is reversed to the upright position, a tray position sensor 90 detects the position of the tray and supplies the detected result to the microcomputer 10. Then, the microcomputer 10 transmits a signal for supplying water to a pump motor controller 60. The pump motor controller 60 drives a pump motor 70 to enable a water supply pump (not shown) to operate. The water supply pump supplies water contained in the water reservoir tank to the tray of the automatic ice maker.

Meanwhile, when a user presses a dispenser lever of the water dispenser installed in the refrigerator door using a cup, a dispenser switch operates. Accordingly, a separate dispenser pump is driven to supply water to the water dispenser from the water reservoir tank, thereby providing the water to the cup of the user.

Also, when a water shortage signal is supplied to the microcomputer 10 from a water reservoir tank level sensor 91 for sensing the level of the water in the water reservoir tank, the microcomputer 10 energizes a water supply warning light-emitting diode (LED) 80 to warn a user to supply water to the water reservoir tank.

However, although water is supplied to the automatic ice maker and the water dispenser from a single water reservoir tank in such a conventional refrigerator, individual water supply pumps are provided therein. As a result, the number of the components increases, to thereby cause the product to become voluminous and costly.

SUMMARY OF THE INVENTION

To solve the above problem, it is an object of the present invention to provide a refrigerator in which water is supplied to an automatic ice maker or a water dispenser using a single water supply pump, while water is preferentially supplied to the water dispenser when the water needs to be supplied to both the automatic ice maker and the water dispenser.

To accomplish the above object of the present invention, there is provided a refrigerator having an automatic ice maker and a water dispenser either of to which water is supplied from a single water reservoir tank, the refrigerator comprising:

a water supply pump for pumping water from the water reservoir tank and supplying the water via a pump supply pipe;

an ice maker pipe and a dispenser pipe which are branched off from the pump supply pipe to supply the water to the automatic ice maker and the water dispenser respectively;

a bidirectional valve which is installed in a branch point of the ice maker pipe and the dispenser pipe to have the pump supply pipe selectively communicate with one of the ice maker pipe and the dispenser pipe; and a controller for controlling the water supply pump and the bidirectional valve for supplying the water to a corresponding pipe when one of the automatic ice maker and the water dispenser needs to be supplied with the water, while preferentially supplying the water to the dispenser pipe when both the automatic ice maker and the dispenser need to be supplied with the water.

Here, the bidirectional valve may be simply a solenoid valve. It is preferable that the solenoid valve supplies water to the ice maker pipe in the turn-off state, and to the dispenser pipe in the turn-on state.

DETAILED DESCRIPTION OF THE PREFERRED EMBODIMENT

A preferred embodiment of the present invention will be described below in more detail with reference to the accompanying drawings.

Figure 1:
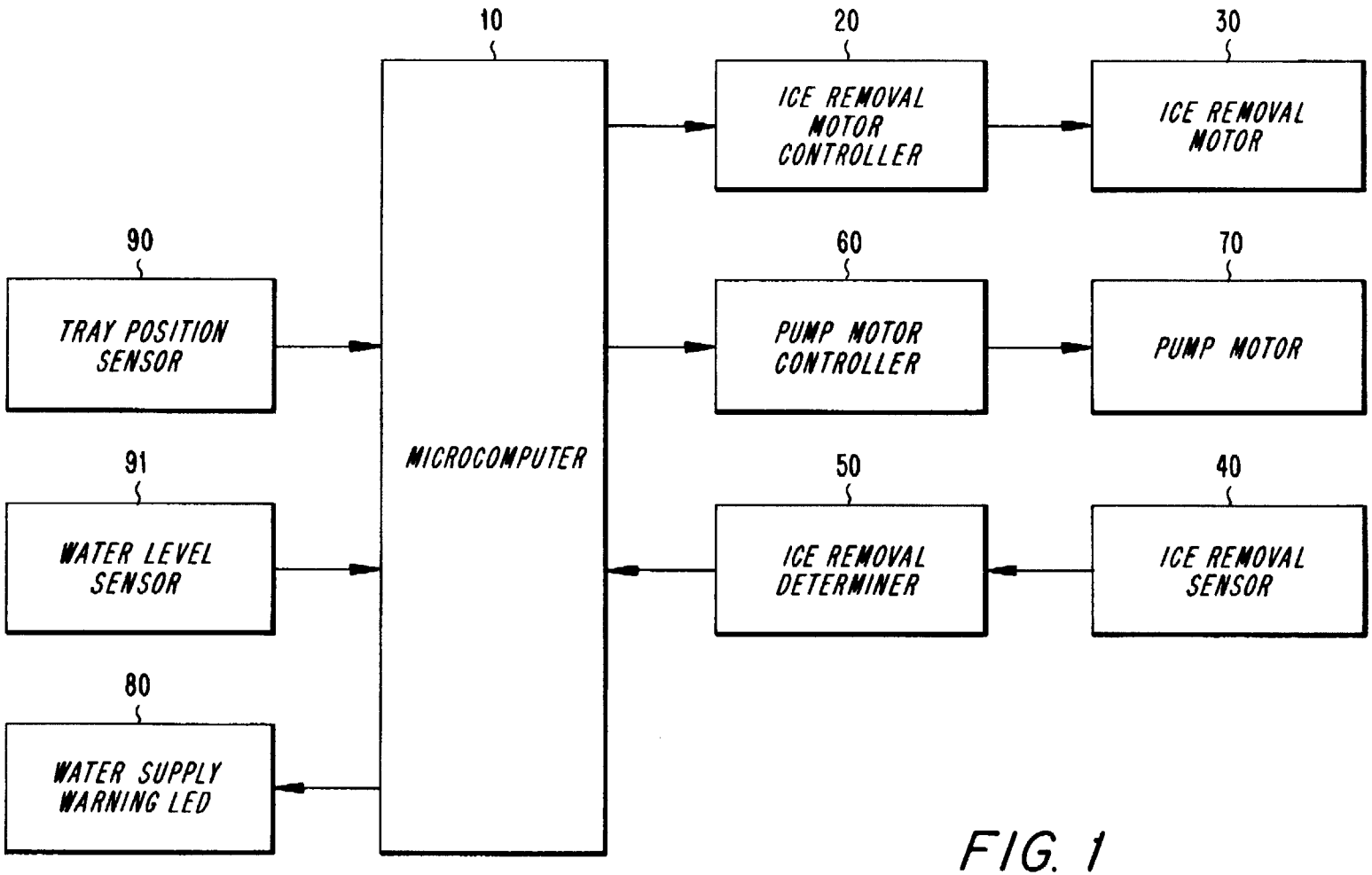
FIG. 1 (PRIOR ART)
FIG. 1 is a block diagram for illustrating a water supply control operation of a conventional automatic ice maker.
Figure 2:
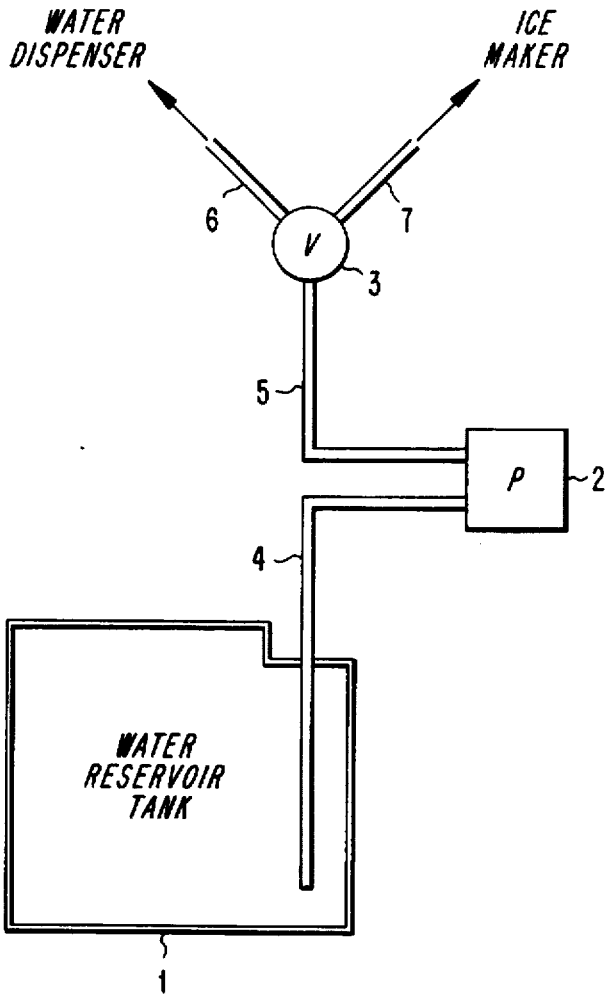
FIG. 2 is a view showing a water supply pipe for an automatic ice maker and a water dispenser in a refrigerator according to the present invention.

As shown in FIG. 2, a water reservoir tank 1 containing water is installed in a refrigerator. A water supply pump 2 pumps the water from the water reservoir tank 1 via an intake pipe 4 and supplies the water via a pump supply pipe 5. A dispenser pipe 6 connected to the water dispenser and an ice maker pipe 7 connected to the automatic ice maker are branched off from the pump supply pipe 5. A bidirectional valve 3 is installed at a branch point of the dispenser pipe 6 and the ice maker pipe 7, in order to have the water selectively flow through one of the dispenser pipe 6 and the ice maker pipe 7. Preferably, the bidirectional valve 3 is comprised of a solenoid valve which operates under control of a controller (not shown) and enables the water to be supplied via a corresponding pipe.

Figure 3:
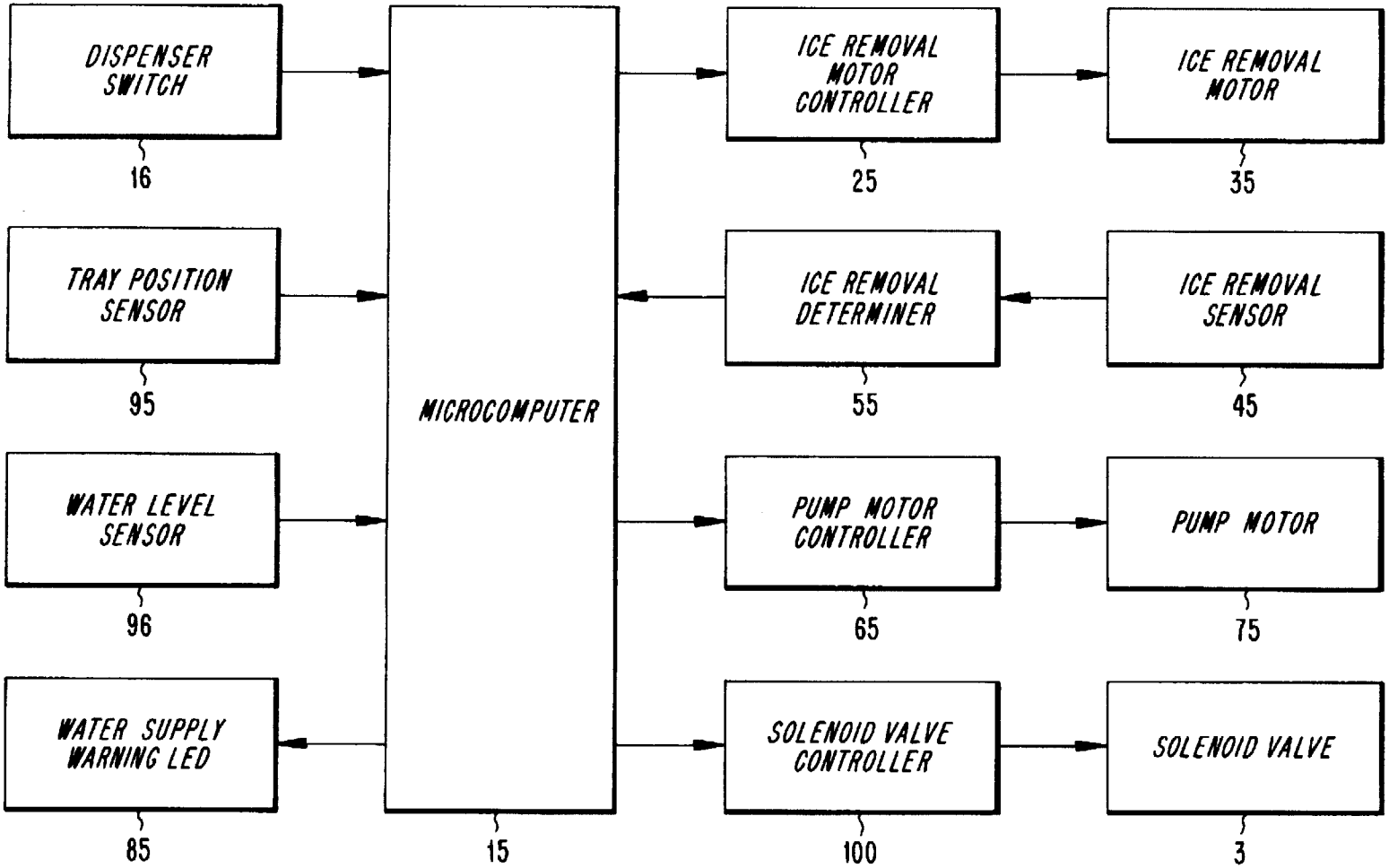
FIG. 3 is a block diagram for explaining a water supply control operation of the FIG. 2 apparatus.

FIG. 3 is a block diagram for explaining a water supply control operation in a refrigerator according to the present invention. A microcomputer 15 for controlling water supply processes of a automatic ice maker and a water dispenser receives a signal output from an ice removal determiner 55 for determining whether the ice should be removed from an ice tray of the automatic ice maker, based on a signal output from an ice removal sensor 45 which senses the temperature of the ice tray, when water contained in the ice tray in the automatic ice maker is completely frozen. The microcomputer 15 outputs a signal for execution of an ice removal operation to an ice removal motor controller 25 according to the signal of the ice removal determiner 55. Thus, the ice removal motor controller 25 drives an ice removal motor 35 for having the ice tray inverted to remove the ice from the ice tray.

If the ice tray of the automatic ice maker is reversed to the former position after the ice removal operation has been completed, a tray position sensor 95 detects that the tray has been reversed to the former position and supplies the detected result to the microcomputer 15. Then, the microcomputer 15 sends a signal for the execution of a water supply operation to a pump motor controller 65. The pump motor controller 65 drives a pump motor 75 to enable a water supply pump to operate. Also, a solenoid valve controller 100 for controlling the solenoid valve 3 is connected to the microcomputer 15. The solenoid valve plays a role of selectively connecting water supplied from the water supply pump 2 with the dispenser pipe 6 running toward the water or the ice maker pipe 7. The solenoid valve connects the pump supply pipe 5 with the ice maker pipe 7 in the valve-off state, while the valve connects the pipe 5 with the dispenser pipe 6 in the valve-on state.

Meanwhile, a dispenser switch 16 of the water dispenser is connected to the microcomputer 15. The dispenser switch 16 is turned on when a user presses a dispenser lever installed on a door of the refrigerator, using a cup and sends the turn-on signal to the microcomputer 15. Then, the microcomputer 15 sends a signal to the pump motor controller 65 to drive the pump motor 75. At the same time, the microcomputer 15 sends a signal to the solenoid valve controller 3 to enable the solenoid valve 100 to be turned on and the pump supply pipe 5 to communicate with the dispenser pipe 6.

The microcomputer 15 also receives a signal supplied from a water level sensor 96 for detecting a water level in the water reservoir tank 1, and enables a water supply warning LED 85 when the water contained in the water reservoir tank 1 is insufficient, to have a user supply water to the water reservoir tank 1.

Figure 4A:
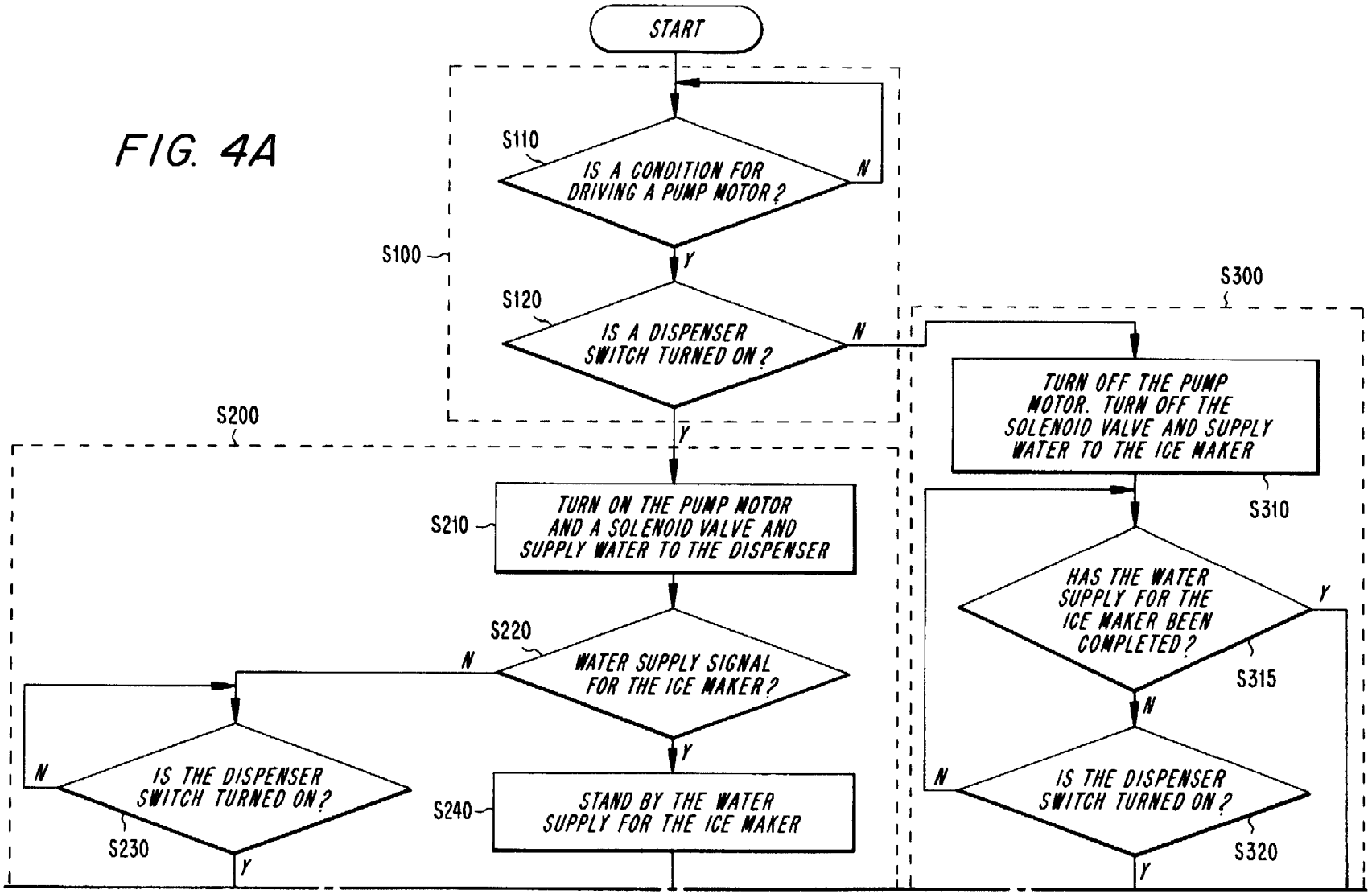
FIGS. 4A and 4B depict a flowchart diagram illustrating a water supply control process according to the invention.
Figure 4B:
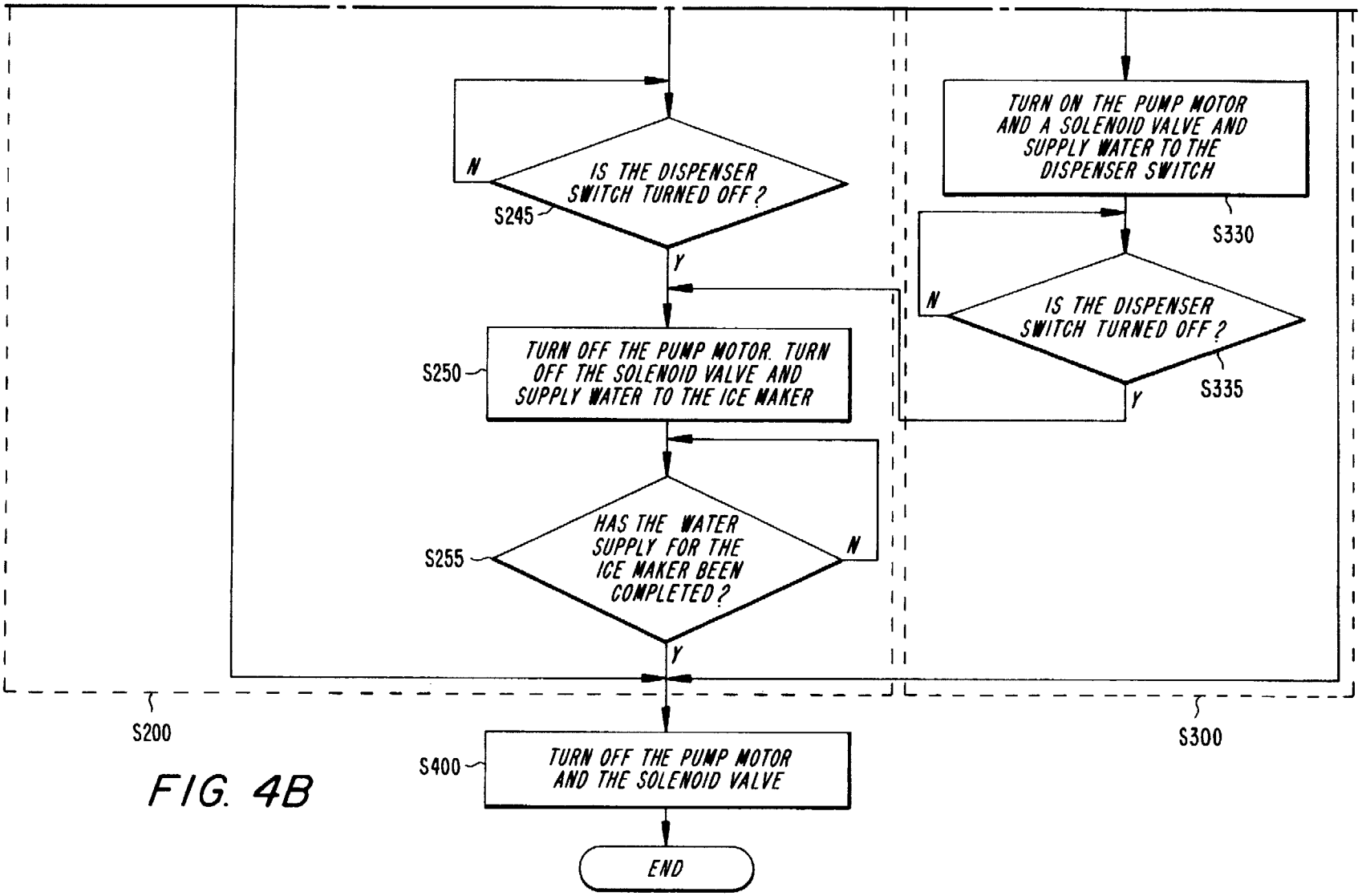

FIGS. 4A, 4B depict a flowchart diagram illustrating a water supply control process in a refrigerator. The water supply control process includes step S100 for determining a water supply condition as to which one of the automatic ice maker and the water dispenser needs to be supplied with water. As will be explained below, whenever there occurs a simultaneous need for water at the dispenser and the ice tray, the dispenser will be given priority at step S200 water is supplied to the water dispenser if the water dispenser needs water and that supply is completed even if a water supply condition for supplying water to the automatic ice maker arises during the supplying of water toward the water dispenser. At step S300 water is supplied to the automatic ice maker in case of determining that only the ice maker needs water in the determining step S100, but the supplying of water toward the automatic ice maker is temporarily halted if a water supply condition for supplying water to the water dispenser is arises before the automatic ice maker toward the water dispenser and then toward the automatic ice maker, and step S400 for turning off a pump motor 75 and a solenoid valve 110 when the water supply toward the water dispenser and the automatic ice maker in the steps S200 and S300 to complete the water supply.

In the water supply condition determining step S100, it is determined whether or not the pump motor 75 is in the drive condition in step S110. The drive condition of the pump motor is generated when the automatic ice maker completes an ice removal operation to place the ice tray into an original position, or a user presses the water supply lever of the water dispenser using a cup, to enable the dispenser switch to be turned on. If the pump motor is in the drive condition, it is determined whether or not the dispenser switch is turned on in step S120. If the dispenser switch is turned on, the water dispenser needs water to be supplied, while if the former is turned off, the ice maker needs water to be supplied.

When only the water dispenser needs to be supplied with water in the water supply condition determination step S110, that is, when a user turns on the dispenser switch in the step S120, the microcomputer 15 turns on the pump motor 75 to drive the water supply pump 2, and simultaneously turns on the solenoid valve 3 to close a water flow path from the water reservoir tank to the automatic ice maker and to open a water flow path from the former to the water dispenser to supply water to the water dispenser in step S210. If a water supply condition for the automatic ice maker is not given in step S220, during the time of supplying water toward the water dispenser in step S210, water continues to be supplied to the water dispenser in step S230. When the water supply operation is completed, the pump motor 75 and the solenoid valve 3 are turned off in step S400 to complete the water supply process.

If a water suppler condition for the automatic ice maker is given in step S220, during the time of supplying water toward the water dispenser in step S210, a water supply operation toward the automatic ice maker is placed in a standby state in step S240, and water continues to be supplied to the water dispenser in step S245. Thus, when a user needs water via the water dispenser, the water is supplied to the water dispenser in preference to the automatic ice maker, to thereby avoid inconvenience to the user. When the water supply operation toward the water dispenser is completed in step S245, the pump motor 75 is turned on and the solenoid valve 3 is turned off in step S250, to divert the water supplied from the water supply pump to the automatic ice maker. When the water supply operation toward the automatic ice maker is completed in step S255, the pump motor 75 and the solenoid valve 3 are turned off in step S400 to complete the water supply process.

Meanwhile, when only the automatic ice maker needs to be supplied with water in the water supply condition determination step S110, that is, when the ice tray is reversed to the former position and the dispenser switch is in the turn-off state, after an ice removal operation of the automatic ice maker has been completed in the step S120, the microcomputer 15 judges that water should be supplied to the automatic ice maker, and turns on the pump motor 75 and simultaneously turns off the solenoid valve 3. Accordingly, a water flow path from the water reservoir tank to the water dispenser is closed and a water flow path from the former to the water dispenser is open to supply water to the automatic ice maker in step S310. When the water supply operation toward the automatic ice maker is completed in step S315, the pump motor 75 is turned off in step S400 to complete the water supply process. In this case, an amount of the water to be supplied to the tray of the automatic ice maker is controlled by the driving time of the pump motor 75.

If the dispenser switch is turned on in step S320, during the time of supplying water toward the automatic ice maker in step S315, the microcomputer 15 maintains the turn-on state of the pump motor and turns on the the solenoid valve 3, to thereby divert the water flow path to the water dispenser. That is, the water supply toward the automatic ice maker is interrupted and the water supply toward the water dispenser is executed in step S330. When the dispenser switch is subsequently turned off dispenser, the solenoid valve 3 is turned off to reinitiate the supplying of water to the automatic ice maker to supplement the insufficient water therein in step S250.

When the water supply operation toward the automatic ice maker is completed, the pump motor 75 and the solenoid valve 3 are turned off in step S400 to complete the water supply process.

As described above, the refrigerator according to the present invention enables a single water supply pump to supply water to an automatic ice maker and a water dispenser, to simplify the structure thereof. When the automatic ice maker and the water dispenser, water is supplied to the water dispenser in preference to the automatic ice maker. Accordingly, inconveniences which can occur due to use of the single water supply pump are solved.

What is claimed is:

1. A refrigerator comprising:

an automatic ice maker;

a water dispenser for dispensing water to the outside of the refrigerator;

a water reservoir tank;

water supply conduits for supplying water respectively to the ice maker and the dispenser from the reservoir;

a valve for selectively connecting one of the water supply conduits with the reservoir;

a pump disposed upstream of the valve for supplying water from the reservoir;

a first sensor for determining when the ice maker needs water and transmitting a first water-needed signal;

a second sensor for determining when the dispenser needs water, and transmitting a second water-needed signal; and a controller connected to the valve, the pump, and the first and second sensors for supplying water to the dispenser when a second water-needed signal is being received, regardless of whether a first water-needed signal is also being received, and for supplying water to the ice maker when a first water-needed signal is being received and no second water-needed signal is being received.

2. The refrigerator according to claim 1 wherein the valve is a solenoid valve.

3. The refrigerator according to claim 2 wherein the solenoid valve is switchable between on and off states; in the on state, the valve communicates the reservoir with the dispenser; in the off state, the valve communicates the reservoir with the ice maker.

* * * * *